US011920459B2

(12) United States Patent
Li et al.

(10) Patent No.: US 11,920,459 B2
(45) Date of Patent: Mar. 5, 2024

(54) ESTIMATING RATE OF PENETRATION USING PAD DISPLACEMENT MEASUREMENTS

(71) Applicant: Schlumberger Technology Corporation, Sugar Land, TX (US)

(72) Inventors: Ling Li, Cheltenham (GB); Riadh Boualleg, Stonehouse (GB); Denis Li, Houston, TX (US); Prashant Saxena, Sugar Land, TX (US); Kjell Haugvaldstad, Trondheim (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 53 days.

(21) Appl. No.: 17/757,729

(22) PCT Filed: Dec. 9, 2020

(86) PCT No.: PCT/US2020/064107

§ 371 (c)(1),
(2) Date: Jun. 20, 2022

(87) PCT Pub. No.: WO2021/126639

PCT Pub. Date: Jun. 24, 2021

(65) Prior Publication Data

US 2023/0025427 A1 Jan. 26, 2023

Related U.S. Application Data

(60) Provisional application No. 62/952,107, filed on Dec. 20, 2019.

(51) Int. Cl.

| | |
|---|---|
| ***E21B 47/09*** | (2012.01) |
| ***E21B 7/06*** | (2006.01) |
| ***E21B 47/024*** | (2006.01) |

(52) U.S. Cl.
CPC ..... *E21B 47/024* (2013.01); *E21B 7/064* (2013.01); *E21B 47/09* (2013.01)

(58) Field of Classification Search
CPC ..... E21B 47/024; E21B 47/09; E21B 7/064
See application file for complete search history.

(56) References Cited

U.S. PATENT DOCUMENTS 5,321,982 A 6/1994 Fay et al.
6,109,372 A * 8/2000 Dorel ..... E21B 7/06 175/269

(Continued)

FOREIGN PATENT DOCUMENTS

WO 2002103158 A1 12/2002
WO 2015123318 A1 8/2015

OTHER PUBLICATIONS

International Search Report and Written Opinion in International Patent Application No. PCT/US2020/064107, dated Mar. 15, 2021, 9 pages.

*Primary Examiner* — Taras P Bemko
(74) *Attorney, Agent, or Firm* — Jeffrey D. Frantz

(57) ABSTRACT

A method for drilling a subterranean wellbore includes rotating a drill string in the subterranean wellbore to drill the wellbore. The drill string includes a rotary steerable tool or a steerable drill bit including at least first and second axially spaced pads configured to extend radially outward from a tool body and engage a wall of the wellbore. Radial displacements of each of the first and second axially spaced pads are measured while drilling. The measured radial displacements are processed to compute a rate of penetration of drilling.

20 Claims, 7 Drawing Sheets

(56) References Cited

U.S. PATENT DOCUMENTS

| | | | | |
|---|---|---|---|---|
| 6,206,108 | B1 | 3/2001 | MacDonald et al. | |
| 6,769,497 | B2 * | 8/2004 | Dubinsky | E21B 44/005 175/45 |
| 7,058,512 | B2 | 6/2006 | Downton | |
| 7,946,357 | B2 | 5/2011 | Trinh et al. | |
| 9,238,958 | B2 | 1/2016 | Teodorescu | |
| 9,297,251 | B2 * | 3/2016 | Poitzsch | E21B 47/07 |
| 9,970,285 | B2 * | 5/2018 | Sugiura | E21B 45/00 |
| 11,060,394 | B2 * | 7/2021 | Westerwaal Gheorghe | G01V 5/08 |
| 11,280,187 | B2 | 3/2022 | Boualleg et al. | |
| 2002/0062992 | A1 | 5/2002 | Fredericks et al. | |
| 2002/0195276 | A1 | 12/2002 | Dubinsky et al. | |
| 2004/0237640 | A1 * | 12/2004 | Meister | E21B 49/006 73/152.48 |
| 2011/0060527 | A1 * | 3/2011 | Teodorescu | E21B 47/01 702/9 |
| 2015/0322720 | A1 * | 11/2015 | Pelletier | E21B 10/602 175/41 |
| 2016/0032717 | A1 | 2/2016 | Parker | |
| 2016/0327680 | A1 | 11/2016 | Jain | |
| 2017/0204726 | A1 * | 7/2017 | Lecampion | H04L 27/223 |
| 2018/0179884 | A1 * | 6/2018 | Doelalikar | E21B 7/04 |
| 2021/0040796 | A1 * | 2/2021 | Azar | E21B 7/06 |

* cited by examiner

ESTIMATING RATE OF PENETRATION USING PAD DISPLACEMENT MEASUREMENTS

CROSS REFERENCE TO RELATED APPLICATIONS

This application is a 371 National Stage filing of International Patent Application No. PCT/US2020/064107, filed Dec. 9, 2020, which claims the benefit of, and priority to, U.S. Patent Application No. 62/952,107, filed Dec. 20, 2019. Each of the foregoing is expressly incorporated herein by this reference in its entirety.

BACKGROUND

Logging while drilling (LWD) and measurement while drilling (MWD) techniques for determining numerous formation and borehole characteristics are well known in oil well drilling and production applications. In recent years there has been a keen interest in deploying sensors as close as possible to the drill bit (or even in the drill bit). Those of skill in the art will appreciate that reducing the distance between the sensors and the bit reduces the time between drilling and measuring the formation and/or borehole properties. This is believed to lead to a reduction in formation contamination (e.g., due to drilling fluid invasion or wellbore washout) and therefore to MWD and LWD measurements that are more likely to be representative of the pristine wellbore and formation properties. In geosteering applications, it is further desirable to reduce the latency between cutting and logging so that steering decisions may be made in a timely fashion.

One difficulty in deploying sensors at or near the drill bit is that the lower BHA tends to be particularly crowded with essential drilling and steering tools, e.g., often including the drill bit, a steering tool, and a near-bit stabilizer. At bit and/or near bit deployment of sensors is known, however, since LWD and MWD sensors generally require complimentary electronics, e.g., for digitizing, pre-processing, saving, and transmitting the sensor measurements, such deployments can compromise the integrity of the lower BHA.

SUMMARY

In some embodiments, a method for drilling a subterranean wellbore includes rotating a drill string in the subterranean wellbore to drill the wellbore. The drill string includes a rotary steerable tool or a steerable drill bit including at least first and second axially spaced pads configured to extend radially outward from a tool body and engage a wall of the wellbore. Radial displacements of each of the first and second axially spaced pads are measured while rotating (drilling). The measured radial displacements are processed to compute a rate of penetration of drilling.

In some embodiments, a method for drilling a wellbore through a subterranean formation includes rotating a drill string in the subterranean wellbore to drill. The drill string includes a rotary steerable tool or a steerable drill bit including a plurality of pads configured to extend radially outward from a tool body and engage a wall of the wellbore. Radial displacements of at least one of the pads are measured while rotating (e.g., drilling). The measured radial displacements are processed to compute a formation index while drilling, wherein the formation index is indicative of a strength or hardness of the subterranean formation.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Methods for drilling a subterranean wellbore are disclosed. In some embodiments, the methods include rotating a drill string in the subterranean wellbore to drill the wellbore. The drill string may include a drill collar, a drill bit, and a rotary steerable tool. The rotary steerable tool is configured to rotate with the drill string and includes a plurality of pads configured to extend and retract outward and inward from the tool body and thereby control the direction of drilling. In some embodiments the drill string may include a steerable bit (or a rotary steerable system adjacent to the bit) including a plurality of pads configured to extend and retract and thereby control the direction of drilling. Pad extension measurements made while drilling may be processed to compute a number of drilling, wellbore, and formation parameters. For example, in some embodiments, the pad extension measurements may be processed to determine a wellbore caliper (e.g., including both the size and shape of the wellbore cross section). In some embodiments, the piston extension measurements may be processed to determine a rate of penetration of drilling. In some embodiments, the piston extension measurements may be processed to determine a formation index (e.g., a parameter related to formation hardness or strength).

Embodiments of the disclosure may provide various technical advantages and improvements over the prior art. For example, in some embodiments, the disclosed embodiments provide an improved method and system for drilling a subterranean wellbore in which wellbore caliper, rate of penetration, and/or a formation index may be obtained from pad extension measurements made on extendable and retractable pads deployed very close to or even in the drilling bit. For example, in certain embodiments, the pads may be deployed in a steerable drill bit or in a rotary steerable tool deployed immediately above the drill bit.

Figure 1:
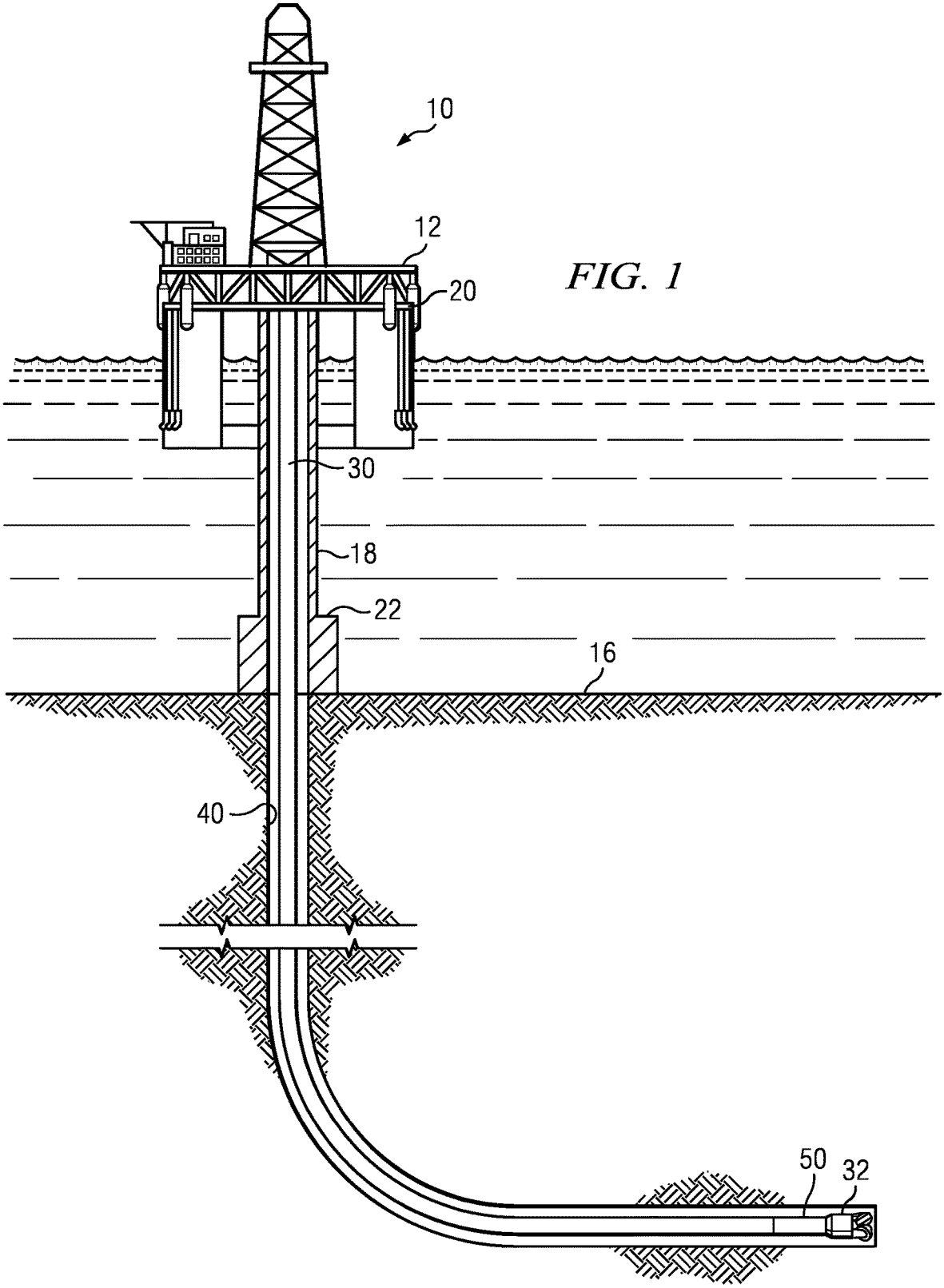
FIG. 1 depicts an example drilling rig on which disclosed embodiments may be utilized.

FIG. 1 depicts a drilling rig 10 suitable for implementing various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a rotary steerable tool 50. Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
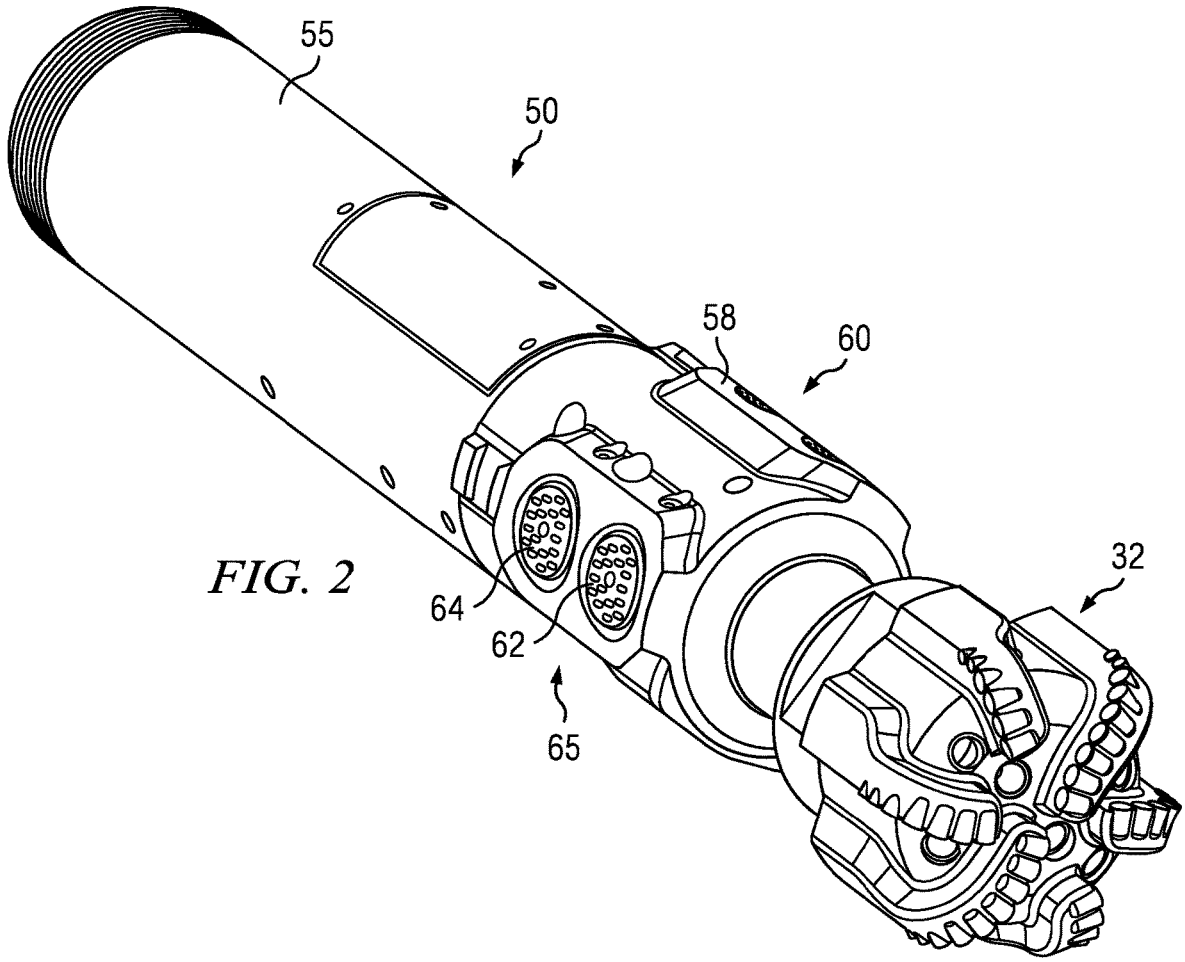
FIG. 2 depicts an example lower BHA portion of the drill string shown on FIG. 1.

FIG. 2 depicts the lower BHA portion of drill string 30 including drill bit 32 and rotary steerable tool 50. The rotary steerable tool may include substantially any suitable steering tool in which the rotary steerable tool collar rotates with the drill string and in which the steering is actuated by the radial extension and retraction of pads (or blades), for example, outward and inward from the tool collar. For example, the PowerDrive rotary steerable systems (available from Schlumberger) fully rotate with the drill string (i.e., the outer tool collar rotates with the drill string). The PowerDrive X5, X6, and Orbit rotary steerable systems make use of mud actuated pads that contact the wellbore wall and thereby steer the direction of drilling (e.g., by forcing the drill bit to cut in a desired direction). The extension of the pads is rapidly and continually adjusted as the system rotates in the wellbore. Certain of the disclosed embodiments may also be implemented on the PowerDrive Archer rotary steerable system, which makes use of a lower steering section joined at a swivel with an upper section. The swivel is actively tilted via displacing internal pistons so as to change the angle of the lower section with respect to the upper section and maintain a desired drilling direction as the bottom hole assembly rotates in the wellbore.

With continued reference to FIG. 2, the example rotary steerable tool embodiment 50 depicted includes a collar (tool body) 55 configured to rotate with the drill string (e.g., via connection to the drill string). The tool includes a plurality of pads 60, at least one of which is configured to extend outward from the collar 55 into contact with the wellbore wall and thereby actuate steering. The pads 60 may be circumferentially spaced about the collar 55 and/or axially spaced along a length of the collar 55. In the depicted embodiment, the tool includes three circumferentially spaced pad pairs 65 (e.g., spaced at 120 degree intervals about the tool circumference). Each pad pair 65 includes first and second axially spaced pads 62 and 64 deployed in/on a gauge surface 58 of the collar 55. The axially spaced pads 62 and 64 may be advantageously deployed in close axial proximity to one another. The use of closely spaced pads may improve accuracy and enable certain parameters (such as rate of penetration) to be measured with minimal delay while drilling. For example, pads 62 and 64 may advantageously have an axial spacing of less than about 60 cm (e.g., less than about 30 cm or less than about 15 cm). The axial spacing of pads 62 and 64 may also be defined with respect to the diameter of the gauge surface 58. For example, the axial spacing may be less than about two times the diameter of the gauge surface (e.g., less than about the diameter of the gauge surface or less than about 0.7 times the diameter of the gauge surface).

Figure 3:
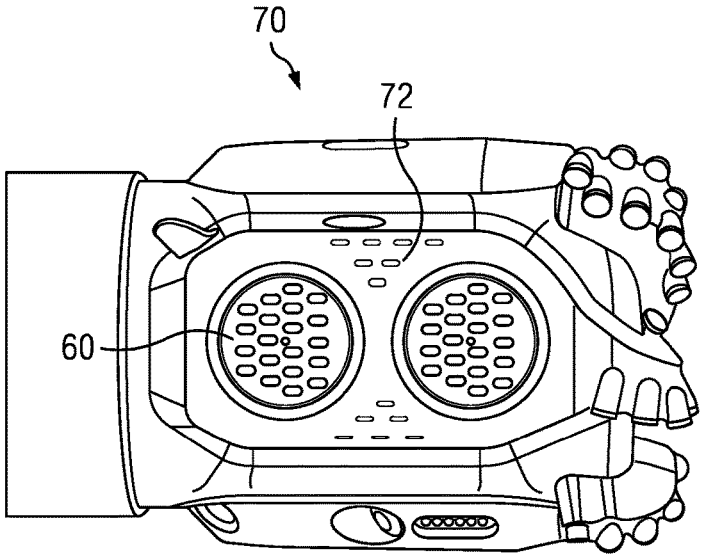
FIG. 3 depicts an example steerable drill bit on which disclosed embodiments may be utilized.

Turning now to FIG. 3, it will be understood that the disclosed embodiments are not limited to rotary drilling embodiments in which the drill bit 32 and rotary steerable tool 50 are distinct separable tools (or tool components). FIG. 3 depicts a steerable drill bit 70 including a plurality of steering pads 60 deployed in the sidewall of the bit body 72 (e.g., on wellbore gauge surfaces). Steerable bit 70 may be thought of as an integral drilling system in which the rotary steerable tool and the drill bit are integrated into a single tool (drill bit) body 72. Drill bit 70 may include substantially any suitable number of pads 60, for example, three pairs of circumferentially spaced pad pairs in which each pad pair includes first and second axially spaced pads as described above with respect to FIG. 2. The disclosed embodiments are not limited in this regard.

With continued reference to FIGS. 2 and 3, in some embodiments, the pads 60 may be deployed close to the cutting surface (cutting elements) of the drill bit. For example, the downhole pad 62 (i.e., the pad closest to the cutting elements) may be deployed less than about 3 meters (e.g., less than about 1.5 meters or less than about 1 meter) above the cutting surface of the drill bit 32, 70. In some embodiments, the downhole pad may be deployed less than about 60 cm (e.g., less than about 30 cm) above the cutting surface of the bit, e.g., when the pads are deployed in a steerable drill bit (such as drill bit 70 shown on FIG. 3).

The deployment of the pads 60 may also be defined with respect to the diameter of the gauge surface 58. For example, the axial spacing between the downhole pad (e.g., pad 62 in FIG. 2) and the cutting surface of the bit may be less than about 15 times the diameter of the gauge surface (e.g., less than about 10 times the diameter of the gauge surface or less than about 8 times the diameter of the gauge surface). In embodiments in which the pads are deployed in a steerable drill bit (such as drill bit 70 shown on FIG. 3), the axial spacing between the downhole pad and the cutting surface of the bit may advantageously be less than about 5 times the diameter of the gauge surface (e.g., less than about 3 times or less than about 2 times the diameter of the gauge surface).

Figure 4A:
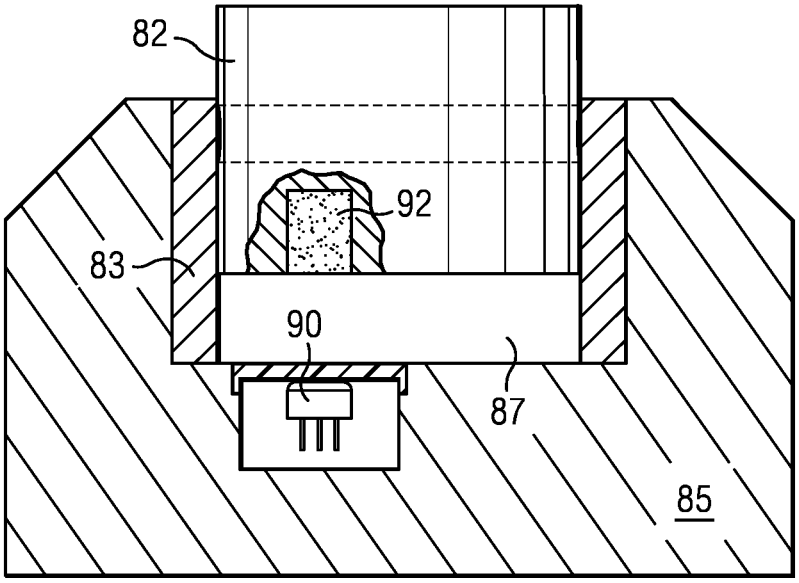
FIGS. 4A and 4B (collectively FIG. 4) depict cross sectional views of an example piston shown on FIG. 2 in extended (4A) and retracted (4B) positions.
Figure 4B:
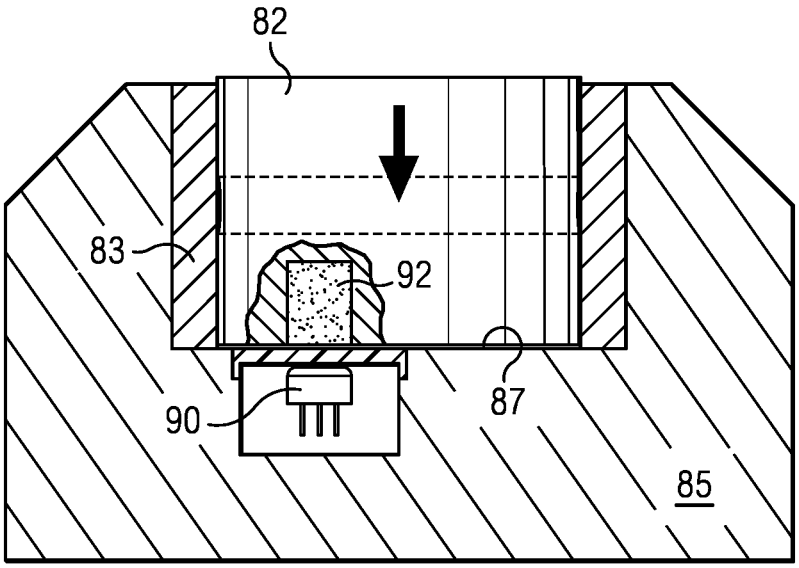

FIGS. 4A and 4B (collectively FIG. 4) depict cross sectional views of one of pads 60 shown in fully extended (4A) and fully retracted (4B) positions. In the example embodiment shown, a piston 82 is deployed in a corresponding sleeve 83 in pad housing 85. As noted above, the piston 82 is configured to extend outward (as shown on FIG. 4A) from the housing 85, for example, via porting drilling fluid to cavity 87 (which is located radially behind the piston 82). In some embodiments, the piston may be biased inwards, for example, via the use of a conventional spring mechanism such that the piston 82 retracts when drilling fluid is diverted away from the cavity 87 (shown fully retracted in FIG. 4B). In some embodiments, the force of the piston against the borehole wall without fluid flowing to the pad is sufficient to cause the piston 82 to retract.

The pad assembly is equipped with a sensor 90 configured to measure the extension (radial displacement) of the piston 82 (e.g., the outward extension of the pad from a fully retracted position). The sensor 90 may include a magnetic sensor configured to measure magnetic flux emanating from a magnet 92 deployed on the piston 82. For example, the magnetic sensor may include a Hall Effect sensor that measures the strength of the magnetic field emanating from magnet 92 and thereby computes the extension of the piston 82. Any suitable displacement measurement sensor may be used, e.g., any sensor that is capable of directly or indirectly measuring the varying extension of the piston may be used.

As noted above, at least one of the pads is instrumented such that that the radial displacement (extension) of the pad may be measured (quantified). By radial displacement is meant the outward extension of the pad from the fully retracted position. In some embodiments, first and second axially spaced pads are instrumented. In other embodiments, each of the circumferentially spaced pads and/or axially spaced pads may be instrumented.

Figure 5:
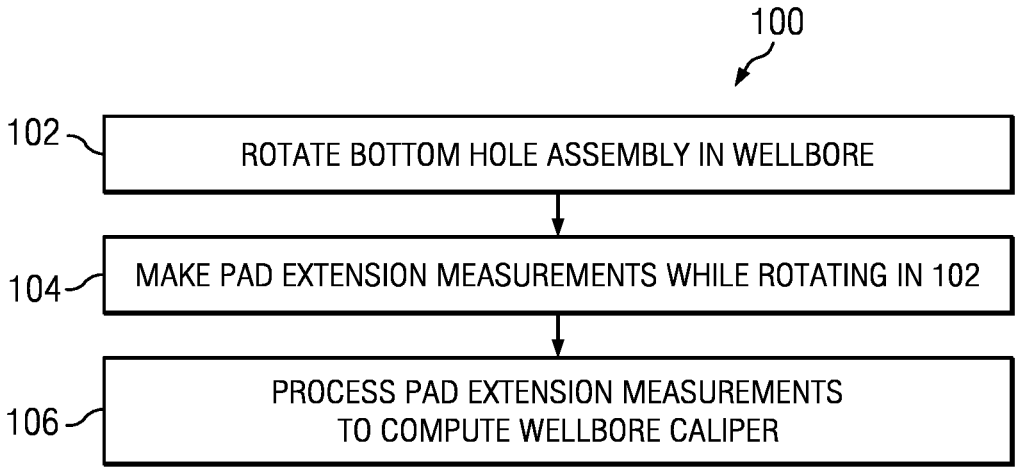
FIG. 5 depicts a flow chart of a method for drilling a subterranean wellbore.

FIG. 5 depicts a flow chart of one example method embodiment 100 for drilling a subterranean wellbore. A bottom hole assembly (e.g., as depicted on FIGS. 1 and 2 or including a steerable drilling bit as depicted on FIG. 3) is rotated in the wellbore at 102 to drill the well. The bottom hole assembly includes a plurality of pads deployed close to the drill bit (e.g., as described above with respect to FIGS. 2 and 3). Pad extension measurements are made at one or more of the pads while drilling (i.e., while rotating the bottom hole assembly in the wellbore) at 104 and are processed at 106 to compute a wellbore calliper.

In some embodiments, the bottom hole assembly includes at least three circumferentially spaced pads (e.g., as depicted on FIGS. 2 and 3). Pad extension measurements are made at each of the pads in 104. Corresponding magnetometer measurements are made to determine a toolface angle of at least one of the pads. The toolface angle of the other pads can be determined from the known circumferential spacing. The piston extension measurements (e.g., the three extension measurements) may then be processed to compute the center of the wellbore, the center offset of the steering tool 50 or steerable bit 70, the wellbore diameter, and the wellbore shape using geometry and trigonometry.

Figure 6A:
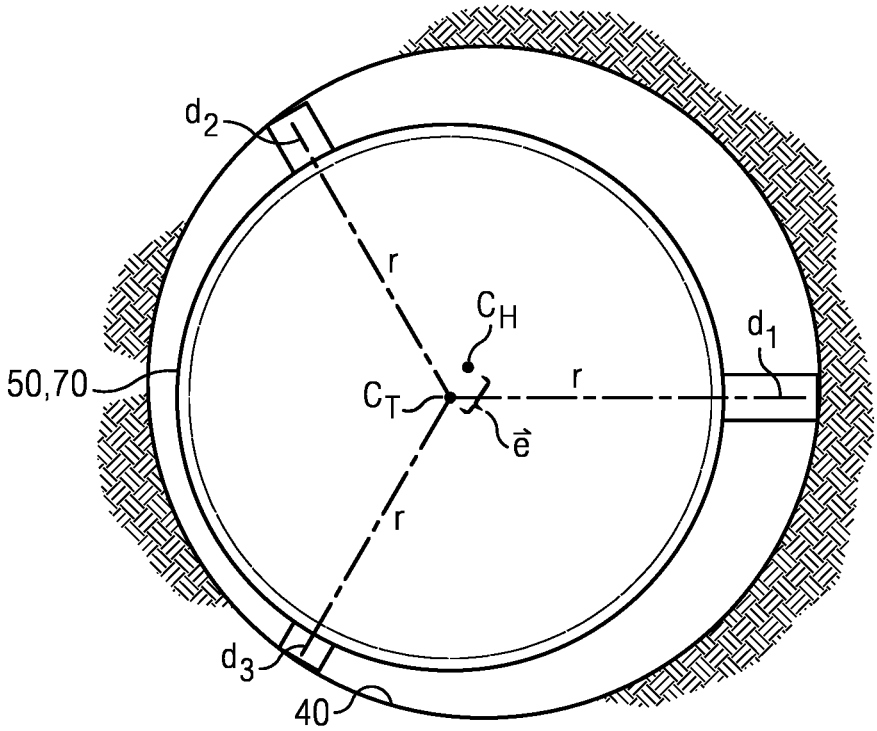
FIG. 6A depicts a cross sectional schematic of a steering tool or steerable drill bit deployed in a wellbore.

FIG. 6A depicts a cross sectional schematic of a steering tool 50 or steerable drill bit 70 deployed in wellbore 40. In the depicted schematic, the center of the tool $C_T$ is offset from the center of the wellbore $C_H$ by eccentering vector $\vec{e}$. The circumferentially offset pads are extended into contact with the wellbore wall as depicted at corresponding piston displacements of $d_1$, $d_2$, and $d_3$. The tool radius r may be defined for example as the distance from $C_T$ to the pad when the pad is fully retracted. In the tool reference frame (in which the center of the tool $C_T$ is located at (0,0)), the extended pads are located distances $r+d_1$, $r+d_2$, and $r+d_3$ from $C_T$. It will be understood that the extended pads represent three distinct points along the circumference of the wellbore. Assuming that the wellbore has a circular cross section, these points may be processed to determine the center of the wellbore $C_H$ in the tool coordinate system (as three points can be used to define a circle). The center of the wellbore may then be processed in combination with the center of the tool $C_T$ to determine the eccentering vector $\vec{e}$ (including the center offset distance and center offset direction). The distance between any one of the extended pads and $C_H$ defines the radius (and therefore the diameter) of the wellbore. This process may be repeated as the tool rotates in the wellbore. The extended pad positions trace out the cross sectional profile (shape) of the wellbore while rotating which enables the true cross-sectional shape of the wellbore to be reconstructed. The shape of the wellbore may be compared with a circle to determine the degree of ellipticity of the wellbore or any other measure of circular deviation.

Figure 6B:
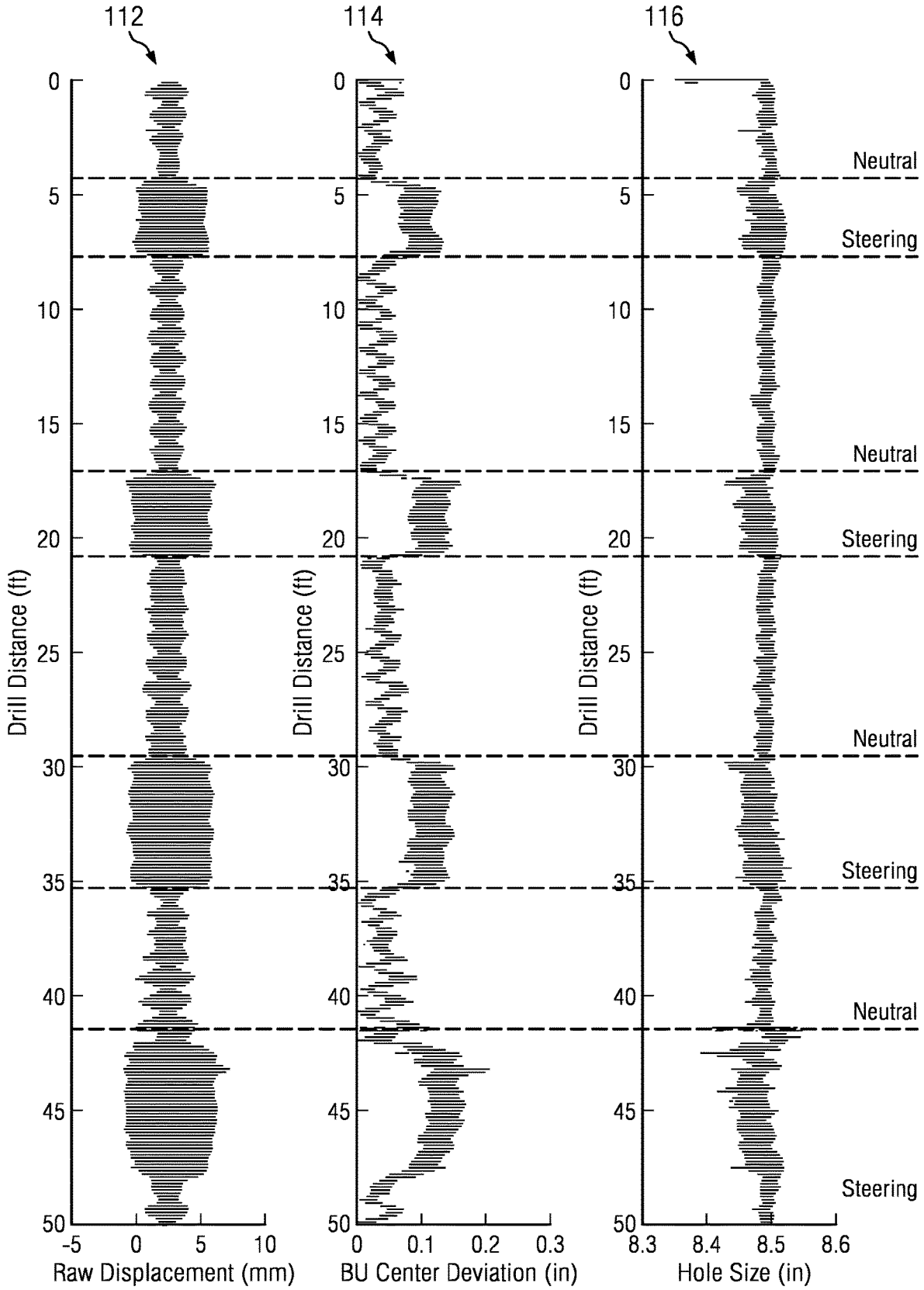
FIG. 6B depicts plots of raw displacement, center offset, and wellbore diameter as a function of measured depth obtained using the method embodiments shown on FIG. 5.

FIG. 6B depicts plots of raw displacement for one of the pads at 112, center offset at 114, and the wellbore diameter at 116 as a function of drilling distance (measured depth along the wellbore). In the depicted embodiment, the drilling tool was switched between neutral and active steering modes as indicated. As described above, the pads are extended and retracted while the tool rotates in the wellbore. During an active steering mode the pads extend and retract at predetermined toolface angles to cause the drill bit to drill in a predetermined direction. For example, when building inclination, the pads are extended at the low side of the wellbore and retracted at the opposing high side of the wellbore such that the drill bit turns upward (builds inclination). During a neutral mode, the toolface angle at which the pads extend and retract change with time as the tool rotates such that drilling tends to proceed straight ahead.

In the operation depicted on FIG. 6B, the raw displacement of the pad(s) increases during steering with a maximum displacement of about 7 mm. Note also that the displacement rapidly oscillates between about 0 and 7 mm as the tool rotates in the wellbore (as described above the pads are extended at a predetermined toolface angle and are retracted at an opposing toolface angle). The center offset also increases while steering as expected (since the direction of drilling is steered by urging the center of the steering tool away from the center of the wellbore). In this particular example, the drilling tool was offset from the center of the wellbore by about 0.1 to about 0.2 inches while steering and oscillated between 0 and 0.05 inch during the neutral phase. The wellbore diameter was about constant at 8.5 inches during the operation (although the average diameter was observed to decrease slightly during active steering).

In some embodiments, the method 100 enables wellbore caliper measurements to be made while drilling and steering. For example, the wellbore diameter, wellbore shape, and position of the steering tool in the wellbore can be measured in real time while drilling and steering. Moreover, the measurements are made very close to the bit (e.g., within a few feet) and are therefore more representative of the performance of the drilling tool prior to washout and/or other factors that degrade wellbore quality.

Figure 7:
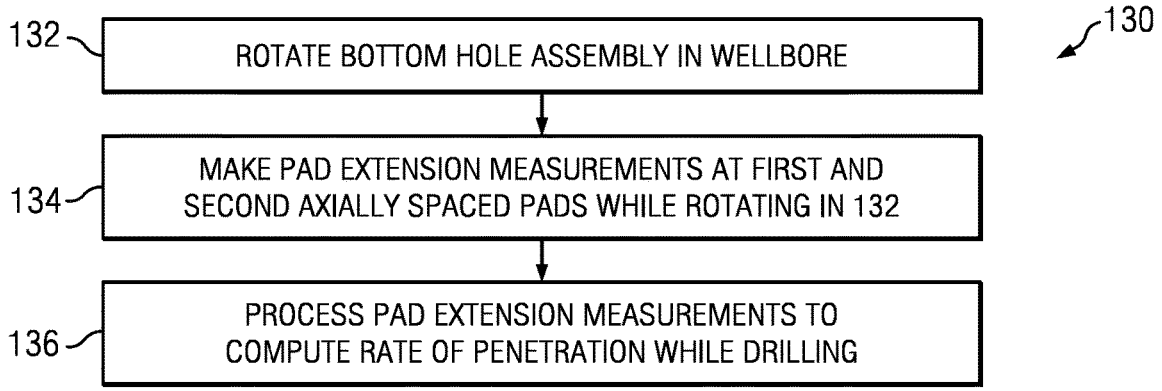
FIG. 7 depicts a flow chart of a method for drilling a subterranean wellbore.

FIG. 7 depicts a flow chart of a method 130 for drilling a subterranean wellbore. A bottom hole assembly (e.g., as depicted on FIGS. 1 and 2 or including a steerable drilling bit as depicted on FIG. 3) is rotated in the wellbore at 132 to drill the well. The bottom hole assembly includes a plurality of axially spaced pads deployed close to the drill bit (e.g., as described above with respect to FIGS. 2 and 3). Pad extension measurements are made at first and second axially spaced pads while drilling (i.e., while rotating the bottom hole assembly in the wellbore) at 134 and are then processed at 136 to compute the rate of penetration of drilling in 132.

The pad extension or displacement measurements may be processed to compute the rate of penetration at 136, for example, by (i) determining the maximum displacements of each of the pads during each revolution of the tool, (ii) optionally low pass filtering (e.g., averaging) the maximum displacements over a predetermined number of revolutions to reduce noise, (iii) searching for maxima and minima in the maximum displacement measurements (or filtered maximum displacement measurements), (iv) matching the maxima and minima for the uphole and downhole pads to obtain a corresponding time delay Δt between the two sets of displacement measurements, and (v) computing the rate of penetration according to Equation 1:

$$ROP = D/\Delta t \quad \text{Eq. 1}$$

where ROP represents the rate of penetration, D represents the axial spacing (distance) between the first and second axially spaced pads on the steering tool (or steerable bit), and Δt represents the time delay obtained in (iv). It will be understood that the time delay may also be obtained using cross correlation techniques by measuring similarities in the two pad displacement data sets.

Figure 8:
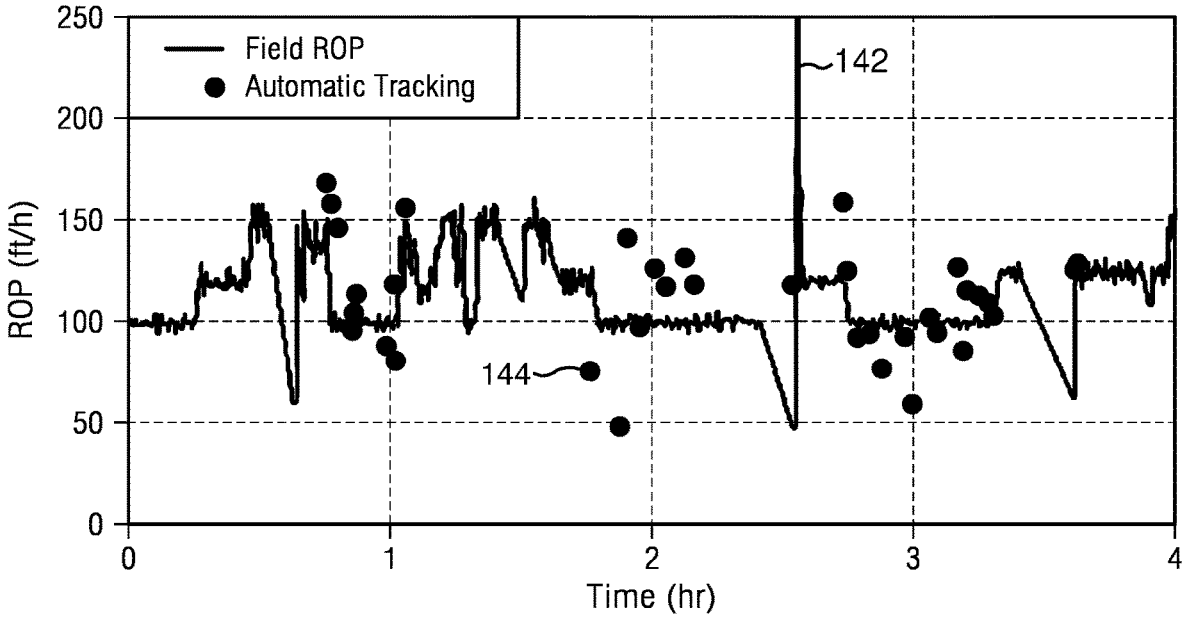
FIG. 8 depicts a plot of rate of penetration as a function of drilling time obtained using the method embodiments shown on FIG. 7.

FIG. 8 depicts a plot of rate of penetration versus drilling time and compares method 130 with surface measured ROP. Conventional surface measured ROP is depicted at 142, while the values measured using downhole method 130 are depicted at 144. As depicted, the ROP values obtained using downhole method 130 are in excellent agreement with the surface measured ROP (with most of the ROP measurements falling within a 25 percent error band).

In some embodiments, the method 130 enables the rate of penetration while drilling to be measured downhole while drilling. As stated above, the ROP values are obtained by processing steering pad displacement measurements made very close to the drill bit. Moreover, the displacement measurements are made on pads that are deployed very close to one another (i.e., that have a small axial spacing). The resulting ROP measurements can therefore be made with a high temporal resolution since the time delay between the two sets of displacement measurements is short for serviceable drilling rates. The use of closely spaced pads also tends to provide good correlation of the pad displacement measurements since the displacement measurements are made prior to washout or other wellbore degradation and therefore may improve the accuracy and reliability of the ROP measurements.

Figure 9:
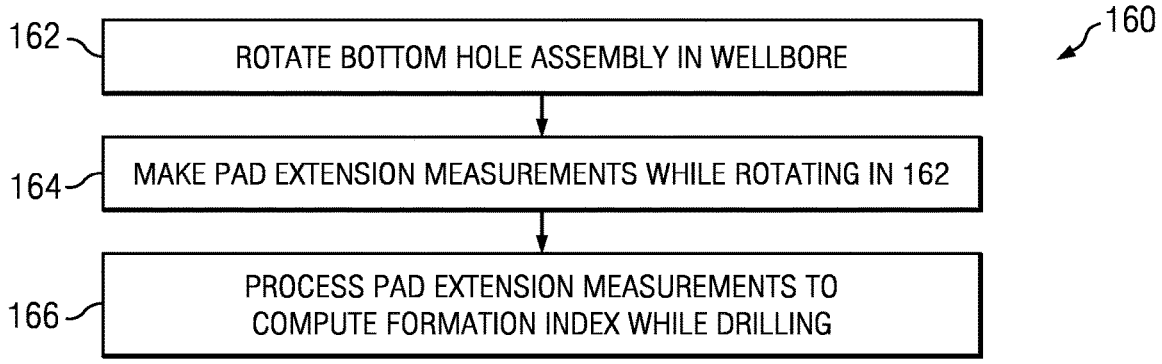
FIG. 9 depicts a flow chart of a method for drilling a subterranean wellbore.

FIG. 9 depicts a flow chart of a method 160 for drilling a subterranean wellbore. A bottom hole assembly (e.g., as depicted on FIGS. 1 and 2 or including a steerable drilling bit as depicted on FIG. 3) is rotated in the wellbore at 162 to drill the well. The bottom hole assembly includes a plurality of axially spaced pads deployed close to the drill bit (e.g., as described above with respect to FIGS. 2 and 3). Pad extension measurements are made at first and second axially spaced pads while drilling (i.e., while rotating the bottom hole assembly in the wellbore) at 164 and are then processed at 166 to compute a formation index that is indicative of a strength or hardness of the formation through which the wellbore penetrates.

The formation index may be estimated based on the force in the pad, which may be represented mathematically, for example, as follows:

$$F = \epsilon \cdot d \cdot \frac{ROP}{RPM} \quad \text{Eq. 2}$$

where F represents the pad force, E represents the formation index, d represents the pad displacement, and RPM and ROP represents the rotation rate and rate of penetration while drilling in 162. Rearranging and solving for E yields the following:

$$\epsilon = \frac{PA}{d} \cdot \frac{RPM}{ROP} \quad \text{Eq. 3}$$

where P represents drilling fluid pressure in the pad and A represents the contact area of the pad. Since the contact area A is believed to remain substantially constant while drilling, the formation index may also be represented mathematically, for example, as follows:

$$\epsilon = \frac{P}{d} \cdot \frac{RPM}{ROP} \quad \text{Eq. 4}$$

With continued reference to FIG. 9, the pad displacement measurements may be processed in combination with other downhole measurements to compute the formation index. The pressure P may be obtained using conventional pressure measurements either in the through bore of the bottom hole assembly or in the piston cavity 87 or may be derived from any suitable measurements. The rotation rate RPM may be measured using conventional techniques, for example, via accelerometers and/or magnetometers deployed in the bottom hole assembly. The rate of penetration ROP may be obtained, for example, as described above with respect to FIG. 7. ROP may also be received via downlink from the surface or simply assumed based on known drilling parameters. For example, a constant valued ROP may be assumed such that the formation index may alternatively be represented mathematically as follows:

$$\epsilon = \frac{P}{d} \cdot \frac{RPM}{k} \quad \text{Eq. 5}$$

where k represents a constant valued rate of penetration or is simply unity to remove the influence of ROP.

As described above with respect to method 130, the pad displacement d may be obtained by processing the pad displacement measurements made while rotating. For example, by computing the maximum displacement the pad during each revolution of the tool and low pass filtering (e.g., averaging) the maximum displacements over a predetermined number of revolutions to reduce noise and obtain an average pad displacement d.

Figure 10:
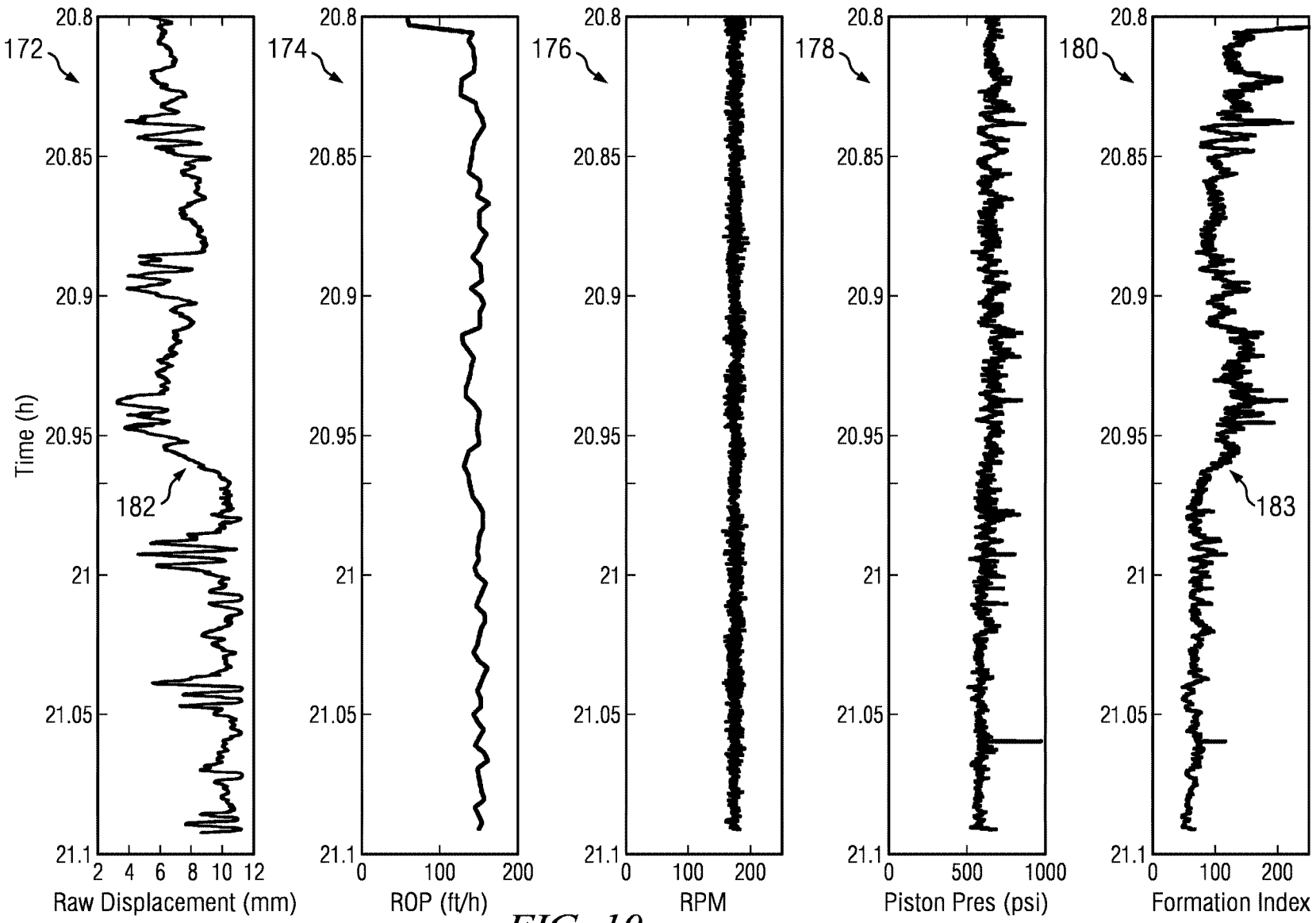
FIG. 10 depicts plots of raw displacement, rate of penetration, rotation rate, drilling fluid pressure, and formation index at as a function of drilling time.

FIG. 10 depicts plots of raw displacement for one of the pads at 172, surface measured ROP at 174, rotation rate RPM at 176, pressure at 178, and formation index at 180 as a function of time while drilling in 162. The plots extend over 18 minutes (0.3 hours) of drilling. A change in formation index is readily observable at about 20.95 hours. Note that the raw displacement of the pad increases from about 7 to about 10 mm at 182 while ROP, RPM, and pressure remain approximately constant indicating a transition from a harder to a softer formation. The corresponding change in formation index is from about 100 (or more) to about 70 at 183.

With further reference to FIGS. 5-10, it will be understood that the parameters computed in methods 100, 130, and 160 (e.g., wellbore diameter, rate of penetration, and formation index) may be stored in downhole memory and/or transmitted to the surface, for example, via mud pulse telemetry, electromagnetic telemetry (or other telemetry techniques). With still further reference to FIGS. 5-10, the computed parameters may be further used in controlling the drilling process. For example, the weight on bit and/or rotation rate of the drill string may be changed to increase or decrease the rate of penetration. Likewise, the drilling fluid flow rate may be changed in response to wellbore caliper measurements and/or formation index. For example, the drilling fluid flow rate/pressure may be reduced in response to caliper measurements showing increased wellbore diameter and/or a reduced formation index. In some embodiments, the computed parameters may be used by components of the BHA to modify drilling parameters downhole. For example, in some embodiments, a steering control scheme of the rotary steerable system may use the ROP measurements to compute depth to modify a drilling trajectory to more accurately follow a planned trajectory. In some embodiments, a steering control scheme of the rotary steerable system may use the formation index to modify steering parameters after identifying a formation change to modify a drilling trajectory continue drilling according to the planned trajectory, e.g., by adjusting the steering ratio.

It will be appreciated that the methods described herein may be implemented individually or in combination during a drilling operation. Moreover, the disclosed methods may be configured for implementation via one or more controllers deployed downhole (e.g., in a rotary steerable tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 5-10. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

It will be understood that this disclosure may include numerous embodiments. These embodiments include, but are not limited to, the following embodiments.

A first embodiment may be a method for drilling a subterranean wellbore. The method may include: (a) rotating a drill string in the subterranean wellbore to drill, the drill string including a rotary steerable tool or a steerable drill bit including at least first and second axially spaced pads configured to extend radially outward from a tool body and engage a wall of the wellbore, the engagement operative to steer a drilling direction; (b) measuring radial displacements of each of the first and second axially spaced pads while rotating in (a); and (c) computing a rate of penetration of drilling in (a) by processing the radial displacements measured in (b).

A second embodiment may include the first embodiment and further include: (d) changing a weight on bit or a rotation rate of the drill string in (a) in response to the rate of penetration of drilling computed in (c).

A third embodiment may include any one of the first two embodiments, where the rate of penetration is computed in (c) using the following mathematical equation: $ROP=D/\Delta t$; where ROP represents the rate of penetration, D represents an axial spacing between the first and second axially spaced pads, and $\Delta t$ represents a time delay between when a feature is observed in the radial displacement measurements made with the first pad in (b) and when an analogous feature is observed in the radial displacement measurements made with the second pad in (b).

A fourth embodiment may include the third embodiment, where (c) includes: (i) determining maximum radial displacements for each of the first and second pads during each revolution while rotating in (a) by processing the radial displacement measurements made in (b); (ii) searching for maxima and minima in the maximum radial displacements; (iii) correlating the maxima and minima for the first and second pads to obtain the corresponding time delay $\Delta t$; and (iv) computing the rate of penetration by processing the time delay.

A fifth embodiment may include the fourth embodiment, where (i) further includes filtering the maximum radial displacements over a predetermined number of revolutions to reduce noise; and (ii) includes searching for maxima and minima in the filtered maximum radial displacements.

A sixth embodiment may include any one of the first through fifth embodiments where the first and second pads have an axial spacing of less than about 30 cm.

A seventh embodiment may include any one of the first through sixth embodiments where the first and second pads have an axial spacing of less than about twice a diameter of a gauge surface of the rotary steerable tool or the steerable drill bit.

An eighth embodiment may include any one of the first through seventh embodiments where the pads are deployed in a rotary steerable tool that is threadably connected with a drill bit and where at least one of the pads is deployed less than 1.5 meters above a lower cutting surface of the drill bit.

A ninth embodiment may include any one of the first through seventh embodiments where the pads are deployed in a steerable drill bit and where at least one of the pads is deployed less than 60 cm above a lower cutting surface of the drill bit.

A tenth embodiment may include any one of the first through ninth embodiments where the method further includes: (d) computing at least one of (i) an eccentering distance between a center of the tool body and a center of the wellbore or (ii) a diameter of the wellbore by processing the radial displacements measured in (b) of at least one of the first or second pads.

An eleventh embodiment may include the tenth embodiment where the rotary steerable tool or the steerable drill bit includes at least three circumferentially spaced pairs of first and second axially spaced pads; the radial displacements are measured in at least one pad in each of the three pairs of first and second axially spaced pads in (b); and the radial displacements measured in (b) in the at least one pad in each of the three pairs of first and second axially spaced pads are processed in (d) to compute the eccentering distance and the diameter of the wellbore.

A twelfth embodiment may be a method for drilling a subterranean wellbore. The method may include: (a) rotating a drill string in the subterranean wellbore to drill, the drill string including a rotary steerable tool or a steerable drill bit including a plurality circumferentially spaced pads configured to extend radially outward from a tool body and engage a wall of the wellbore, the engagement operative to steer a drilling direction; (b) measuring radial displacements of at least one of the plurality of circumferentially spaced pads while rotating in (a); (c) computing at least one of (i) an eccentering distance between a center of the tool body and a center of the wellbore or (ii) a diameter of the wellbore by processing the radial displacements measured in (b).

A thirteenth embodiment may include the twelfth embodiment and may further include: (d) changing a weight on bit or a rotation rate of the drill string in (a) in response to the eccentering distance or the diameter of the wellbore computed in (c).

A fourteenth embodiment may include the twelfth or thirteenth embodiment where: (b) includes measuring radial displacements of each of the plurality of circumferentially spaced pads while rotating in (a); and (c) includes computing the eccentering distance and the diameter of the wellbore by processing the radial displacements measured at each of the plurality of circumferentially spaced pads.

A fifteenth embodiment may include the fourteenth embodiment, where (c) further includes: (c1) computing a center location of the wellbore by processing the radial displacements measured at each of the plurality of circumferentially spaced pads; (c2) computing the eccentering distance by processing the center location of the wellbore and a center location of the rotary steerable tool or the steerable drill bit; or (c3) computing the diameter of the wellbore by processing the radial displacements measured at at least one of the plurality of circumferentially spaced pads.

A sixteenth embodiment may include the fifteenth embodiment, where (c) further includes: (c4) repeating (c1) while rotating in (a) and reconstructing a cross-sectional shape of the wellbore by processing the radial displacements measured at each of the plurality of circumferentially spaced pads.

A seventeenth embodiment may include any one of the twelfth through sixteenth embodiments, where the pads are deployed in a rotary steerable tool that is threadably connected with a drill bit and where at least one of the pads is deployed less than 1.5 meters above a lower cutting surface of the drill bit.

An eighteenth embodiment may include any one of the twelfth through seventeenth embodiments, where the pads are deployed in a steerable drill bit and where at least one of the pads is deployed less than 60 cm above a lower cutting surface of the drill bit.

A nineteenth embodiment may be a system for drilling a subterranean wellbore. The system may include: a rotary steerable tool or a steerable drill bit including at least first and second axially spaced pads configured to extend radially outward from a tool body and engage a wall of the wellbore, the engagement operative to steer a drilling direction; and a downhole controller deployed in the rotary steerable tool or a steerable drill bit, the controller including instructions to (i) measure radial displacements of each of the first and second axially spaced pads while the system rotates in the wellbore and (ii) process the radial displacements measured in (i) to compute a rate of penetration of drilling.

A twentieth embodiment may include the nineteenth embodiment, where the controller is configured to compute the rate of penetration via (iia) determining maximum radial displacements for each of the first and second pads during each revolution while rotating by processing the measured radial displacements, (iib) filtering the maximum radial displacements over a predetermined number of revolutions to reduce noise; (iic) searching for maxima and minima in the filtered maximum radial displacements, (iid) correlating the maxima and minima for the first and second pads to obtain a corresponding time delay $\Delta t$; and (iie) computing the rate of penetration ROP, where $ROP=D/\Delta t$, by processing the time delay and an axial distance D between the first and second pads.

A twenty-first embodiment may be a method for drilling a wellbore through a subterranean formation. The method may include: (a) rotating a drill string in the subterranean wellbore to drill, the drill string including a rotary steerable tool or a steerable drill bit including a plurality of pads configured to extend radially outward from a tool body and engage a wall of the wellbore, the engagement operative to steer a drilling direction; (b) measuring radial displacements of at least one of the pads while rotating in (a); and (c) computing a formation index while drilling in (a), where the formation index is indicative of a strength or hardness of the formation, by processing the radial displacements measured in (b).

A twenty-second embodiment may include the twenty-first embodiment and may further include: (d) changing a weight on bit or a rotation rate of the drill string in (a) in response to the formation index computed in (c).

A twenty-third embodiment may include any one of the twenty-first through the twenty-second embodiments, where the formation index is inversely proportional to the radial displacements measured in (b).

A twenty-fourth embodiment may include any one of the twenty-first through the twenty-third embodiments, where (b) further includes measuring a drilling fluid pressure in the pad while rotating in (a).

A twenty-fifth embodiment may include any one of the twenty-first through the twenty-fourth embodiments, where (b) further includes measuring a drill string rotation rate while rotating in (a).

A twenty-sixth embodiment may include any one of the twenty-first through the twenty-fifth embodiments, where (b) further includes measuring a rate of penetration while drilling while rotating in (a).

A twenty-seventh embodiment may include any one of the twenty-first through the twenty-sixth embodiments, where the formation index is computed using one of the following mathematical equations 6-8:

$$\epsilon = \frac{PA}{d} \cdot \frac{RPM}{ROP} \quad \text{Eq. 6}$$

$$\epsilon = \frac{P}{d} \cdot \frac{RPM}{ROP} \quad \text{Eq. 7}$$

$$\epsilon = \frac{P}{d} \cdot \frac{RPM}{k} \quad \text{Eq. 8}$$

where $\epsilon$ represents the formation index, d represents the pad displacement, P represents drilling fluid pressure in the pad, A represents a contact area of the pad, RPM and ROP represents a rotation rate and a rate of penetration while drilling in (a), and $\alpha$ represents a constant valued rate of penetration.

A twenty-eighth embodiment may include any one of the twenty-first through the twenty-seventh embodiments, where (c) includes: (i) determining maximum radial displacements for the at least one pad during each revolution while rotating in (a) by processing the radial displacement measurements made in (b); (ii) filtering the maximum radial displacements over a predetermined number of revolutions to reduce noise; and (iii) computing the formation index by processing the filtered maximum radial displacements.

A twenty-ninth embodiment may include any one of the twenty-first through the twenty-eighth embodiments, where the pads are deployed in a rotary steerable tool that is threadably connected with a drill bit and where at least one of the pads is deployed less than 1.5 meters above a lower cutting surface of the drill bit.

A thirtieth embodiment may include any one of the twenty-first through the twenty-eighth embodiments, where the pads are deployed in a steerable drill bit and where at least one of the pads is deployed less than 60 cm above a lower cutting surface of the drill bit.

A thirty-first embodiment may include any one of the twenty-first through the thirtieth embodiments, where: the rotary steerable tool or the steerable drill bit includes at least first and second axially spaced pads; (b) includes measuring the radial displacement of each of the first and second axially spaced pads; and (c) includes computing a rate of penetration of drilling by processing the radial displacements measured in (b) and further computing the formation index by processing the radial displacements and the rate of penetration of drilling.

A thirty-second embodiment may include the thirty-first embodiment, where (b) further includes measuring the drilling fluid pressure in the pad, and the rotation rate of the drill string while rotating in (a); and (c) further includes computing the formation index by processing the radial displacements, the drilling fluid pressure, and the rotation rate measured in (b) and the computed rate of penetration of drilling.

A thirty-third embodiment may include any one of the thirty-first through the thirty-second embodiments, where (c) includes: (i) determining maximum radial displacements for each of the first and second pads during each revolution while rotating in (a) by processing the radial displacement measurements made in (b); (ii) searching for maxima and minima in the maximum radial displacements; (iii) correlating the maxima and minima for the first and second pads to obtain the corresponding time delay $\Delta t$; (iv) computing the rate of penetration by processing the time delay; and (v) processing the computed rate of penetration and the maximum displacements for at least one of the pads to compute the formation index.

A thirty-fourth embodiment may include any one of the thirty-first through the thirty-third embodiments, where the first and second pads have an axial spacing of less than about 30 cm.

A thirty-fifth embodiment may include any one of the thirty-first through the thirty-fourth embodiments, where the first and second pads have an axial spacing of less than about twice a diameter of a gauge surface of the rotary steerable tool or the steerable drill bit.

A thirty-sixth embodiment may include any one of the thirty-first through the thirty-fifth embodiments, and may further include: (d) computing at least one of (i) an eccentering distance between a center of the tool body and a center of the wellbore or (ii) a diameter of the wellbore by processing the radial displacements measured in (b) of at least one of the first or second pads.

A thirty-seventh embodiment may include any one of the twenty-first through the thirty-fifth embodiments, and may further include: (d) computing at least one of (i) an eccentering distance between a center of the tool body and a center of the wellbore or (ii) a diameter of the wellbore by processing the radial displacements measured in (b) of at least one of the first and second pads.

A thirty-eighth embodiment may include a system for drilling a wellbore through a subterranean formation. The system may include: a rotary steerable tool or a steerable drill bit including a plurality of axially spaced pads configured to extend radially outward from a tool body and engage a wall of the wellbore, the engagement operative to steer a drilling direction; and a downhole controller deployed in the rotary steerable tool or a steerable drill bit, the controller including instructions to (i) measure radial displacements of at least one of the plurality of pads while the system rotates in the wellbore and (ii) process the radial displacements measured in (i) to compute a formation index, where the formation index is indicative of a strength or hardness of the formation.

A thirty-ninth embodiment may include the thirty-eighth embodiment, where the controller is configured to compute the formation index (iia) determining maximum radial displacements for each of the first and second pads during each revolution while rotating by processing the radial displacement measurements made in (b), (iib) filtering the maximum radial displacements over a predetermined number of revolutions to reduce noise, and (iic) computing the formation index by processing the filtered maximum radial displacements.

A fortieth embodiment may include the thirty-eighth or thirty-ninth embodiment, where the formation index is computed using one of the following mathematical equations 9-11:

$$\epsilon = \frac{PA}{d} \cdot \frac{RPM}{ROP} \quad \text{Eq. 9}$$

$$\epsilon = \frac{P}{d} \cdot \frac{RPM}{ROP} \quad \text{Eq. 10}$$

$$\epsilon = \frac{P}{d} \cdot \frac{RPM}{k} \quad \text{Eq. 11}$$

where $\epsilon$ represents the formation index, d represents the radial displacement, P represents drilling fluid pressure in the pad, A represents a contact area of the pad, RPM and ROP represents a rotation rate and a rate of penetration while drilling, and k represents a constant valued rate of penetration.

Although at- or near-bit pad displacement measurements and certain advantages thereof have been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for drilling a subterranean wellbore, the method comprising:

(a) rotating a drill string in the subterranean wellbore to drill, the drill string including a rotary steerable tool or a steerable drill bit including at least first and second axially spaced pads configured to extend radially outward from a tool body and engage a wall of the wellbore, the engagement operative to steer the drill string a drilling direction;

(b) measuring radial displacements of each of the first and second axially spaced pads while rotating in (a); and (c) computing a rate of penetration of drilling in (a) by processing the radial displacements measured in (b).

2. The method of claim 1, further comprising:

(d) changing a weight on bit or a rotation rate of the drill string in (a) in response to the rate of penetration of drilling computed in (c).

3. The method of claim 1, wherein the rate of penetration is computed in (c) using the following mathematical equation:

$$ROP=D/\Delta t$$

where ROP represents the rate of penetration, D represents an axial spacing between the first and second axially spaced pads, and Δt represents a time delay between when a feature is observed in the radial displacement measurements made with the first pad in (b) and when an analogous feature is observed in the radial displacement measurements made with the second pad in (b).

4. The method of claim 3, wherein (c) comprises:

(i) determining maximum radial displacements for each of the first and second pads during each revolution while rotating in (a) by using the radial displacement measurements made in (b);

(ii) searching for maxima and minima in the maximum radial displacements;

(iii) obtaining the corresponding time delay Δt by correlating the maxima and minima for the first and second pads; and (iv) computing the rate of penetration using the time delay.

5. The method of claim 4, wherein:

determining maximum radial displacements in (i) further comprises filtering the maximum radial displacements over a predetermined number of revolutions to reduce noise; and searching for maxima and minima in (ii) comprises searching for maxima and minima in the filtered maximum radial displacements.

6. The method of claim 1, wherein the first and second pads have an axial spacing of less than about 30 cm.

7. The method of claim 1, wherein the first and second pads have an axial spacing of less than about twice a diameter of a gauge surface of the rotary steerable tool or the steerable drill bit.

8. The method of claim 1, wherein the pads are deployed in a rotary steerable tool that is threadably connected with a drill bit and wherein at least one of the pads is deployed less than 1.5 meters above a lower cutting surface of the drill bit.

9. The method of claim 1, wherein the pads are deployed in a steerable drill bit and wherein at least one of the pads is deployed less than 60 cm above a lower cutting surface of the drill bit.

10. The method of claim 1, further comprising:

(d) computing at least one of (i) an eccentering distance between a center of the tool body and a center of the wellbore or (ii) a diameter of the wellbore by processing the radial displacements measured in (b) of at least one of the first and second pads.

11. The method of claim 10, wherein:

the rotary steerable tool or the steerable drill bit includes at least three circumferentially spaced pairs of first and second axially spaced pads;

the radial displacements are measured in at least one pad in each of the three pairs of first and second axially spaced pads in (b); and computing the eccentering distance or the diameter of the wellbore in (d) includes processing the radial displacements measured in (b) in the at least one pad in each of the three pairs of first and second axially spaced pads.

12. A method for drilling a subterranean wellbore, the method comprising:

(a) rotating a drill string in the subterranean wellbore to drill, the drill string including a rotary steerable tool or a steerable drill bit including a plurality circumferentially spaced pads configured to extend radially outward from a tool body and engage a wall of the wellbore, the engagement operative to steer the drill string in a drilling direction;

(b) measuring radial displacements of at least one of the plurality of circumferentially spaced pads while rotating in (a); and (c) computing at least one of (i) an eccentering distance between a center of the tool body and a center of the wellbore or (ii) a diameter of the wellbore by processing the radial displacements measured in (b).

13. The method of claim 12, further comprising:

(d) changing a weight on bit or a rotation rate of the drill string in (a) in response to the eccentering distance or the diameter of the wellbore computed in (c).

14. The method of claim 12, wherein:

measuring radial displacements in (b) includes measuring radial displacements of each of the plurality of circumferentially spaced pads while rotating in (a); and computing in (c) includes computing the eccentering distance and the diameter of the wellbore by processing the radial displacements measured at each of the plurality of circumferentially spaced pads.

15. The method of claim 14, wherein computing in (c) further comprises:

(c1) compute a center location of the wellbore by processing the radial displacements measured at each of the plurality of circumferentially spaced pads;

(c2) computing the eccentering distance by processing the center location of the wellbore and a center location of the rotary steerable tool or the steerable drill bit; and (c3) computing the diameter of the wellbore by processing the radial displacements measured at at least one of the plurality of circumferentially spaced pads.

16. The method of claim 15, wherein (c) further comprises:

(c4) repeating (c1) while rotating in (a) and reconstructing a cross-sectional shape of the wellbore by processing the radial displacements measured at each of the plurality of circumferentially spaced pads.

17. The method of claim 12, wherein the pads are deployed in a rotary steerable tool that is threadably connected with a drill bit and wherein at least one of the pads is deployed less than 1.5 meters above a lower cutting surface of the drill bit.

18. The method of claim 12, wherein the pads are deployed in a steerable drill bit and wherein at least one of the pads is deployed less than 60 cm above a lower cutting surface of the drill bit.

19. A system for drilling a subterranean wellbore, the system comprising:

a rotary steerable tool or a steerable drill bit including at least first and second axially spaced pads configured to extend radially outward from a tool body and engage a wall of the wellbore, the engagement operative to steer a drilling direction; and a downhole controller deployed in the rotary steerable tool or a steerable drill bit, the controller including instructions to (i) measure radial displacements of each of the first and second axially spaced pads while the system rotates in the wellbore and (ii) compute a rate of penetration of drilling by processing the radial displacements measured in (i).

20. The system of claim 19, wherein the controller is configured to compute the rate of penetration via: (iia) processing the measured radial displacements to determine maximum radial displacements for each of the first and second pads during each revolution while rotating; (iib) filtering the maximum radial displacements over a predetermined number of revolutions to reduce noise; (iic) searching for maxima and minima in the filtered maximum radial displacements; (iid) correlating the maxima and minima for the first and second pads to obtain a corresponding time delay ($\Delta t$); and (iie) computing the rate of penetration (ROP) by processing the time delay and an axial distance (D) between the first and second pads, where $ROP=D/\Delta t$.

* * * * *